US011182982B2

(12) United States Patent
Wang et al.

(10) Patent No.: US 11,182,982 B2
(45) Date of Patent: Nov. 23, 2021

(54) SYSTEMS AND METHODS FOR ELECTRONIC TOLL COLLECTION VIA MOBILE COMMUNICATION DEVICES

(71) Applicants: Fangsong Wang, Palo Alto, CA (US); Yinqing Zhao, Palo Alto, CA (US); Haigang Feng, San Diego, CA (US)

(72) Inventors: Fangsong Wang, Palo Alto, CA (US); Yinqing Zhao, Palo Alto, CA (US); Haigang Feng, San Diego, CA (US)

( * ) Notice: Subject to any disclaimer, the term of this patent is extended or adjusted under 35 U.S.C. 154(b) by 687 days.

(21) Appl. No.: 15/679,101

(22) Filed: Aug. 16, 2017

(65) Prior Publication Data

US 2019/0057557 A1 Feb. 21, 2019

(51) Int. Cl.
*G08G 1/017* (2006.01)
*G07B 15/06* (2011.01)

(52) U.S. Cl.
CPC ..... *G07B 15/063* (2013.01); *G08G 1/017* (2013.01); *G08G 1/0175* (2013.01)

(58) Field of Classification Search
CPC ..... G07B 15/063; G08G 1/0175
USPC ..... 340/928
See application file for complete search history.

(56) References Cited

U.S. PATENT DOCUMENTS 8,311,559 B1 * 11/2012 Morrow ..... H04M 1/7253 455/456.1
8,456,274 B2 * 6/2013 Modiano ..... G07B 15/063 340/5.2
2013/0002407 A1 * 1/2013 Terrier ..... G07B 15/063 340/10.42
2016/0171787 A1 * 6/2016 Yohalashet ..... G07B 15/063 705/13
2018/0018832 A1 * 1/2018 Fustes ..... G06Q 30/04

* cited by examiner

*Primary Examiner* — Qutbuddin Ghulamali

(57) ABSTRACT

A plurality of vehicle identity collection modules are deployed at different toll collecting locations, wherein each vehicle identity collection module is configured to broadcast wireless communication signals to cover a mobile communication device associated with a vehicle passing by the toll collection location over a wireless communication network, wherein strength of the signals is maximized so that mobile communication device switches and connects with the vehicle identity collection module during a wireless cell re-selection process. A mobile communication channel is then established and identification information of one or more of the vehicle, the driver, and the mobile communication device is retrieved via the mobile communication channel. Based on the retrieved information, actual moving path of the vehicle from its initial toll collecting location where the vehicle is first sensed to its current toll collecting location where the vehicle is last sensed is generated and a toll amount is calculated accordingly.

22 Claims, 3 Drawing Sheets

SYSTEMS AND METHODS FOR ELECTRONIC TOLL COLLECTION VIA MOBILE COMMUNICATION DEVICES

BACKGROUND

As a part of an intelligent transportation system (ITS), electronic toll collection (ETC) systems have been adopted at toll collecting locations such as toll booths/stations to automatically identify and collect tolls from vehicles that are passing by without requiring the vehicle to stop (and thus avoiding congestions at the toll collecting locations). A typical ETC system may include multiple on-site ETC units or equipment, including a plurality of Road-Side Units (RSUs) located at the toll collecting locations and On-Board Unit (OBUs) associated (on-board) with the vehicles. When a vehicle is getting close to a toll collecting location, the OBU of the vehicle retrieves the vehicle's identification as well as other toll-relevant information stored on the OBU and communicates with the RSU at the toll collecting location to transmit such information to the RSU. The RSU receives, processes, and transmits such information to back-end processing components of the ETC system for toll calculation and collection/settlement via electronic transaction.

The ETC systems currently being used such as FasTrak® (www.bayareafastrak.org) utilize near field communication (NFC) technology for communication between the RSU and the OBUs, wherein each OBU is a dedicated NFC device, e.g., a toll tag, which can be sensed by an RSU at a toll colleting location when the OBU on a vehicle is in close proximity of the RSU, e.g., when the vehicle with a toll tag attached to it slowly passes by a toll booth via a FasTrak® lane. Such ETC systems require a user/driver to acquire one or more toll tags prior to use the ETC and to carry a toll tag with each vehicle he/she drives at all times. In addition, the signals transmitted by the RSU for NFC are electromagnetic waves having irregular boundaries of its coverage range due to reflection and/or refraction of the electromagnetic waves at obstacles. In order for the RSU to be discoverable by the OBUs, the RSU may often need to amplify its signals, causing the signals to inadvertently cover vehicles in neighboring lanes and/or behind the current vehicle to be sensed, which often leads to errors in toll collection. It is thus desirable to have an ETC system that can accurately identify the passing vehicles at tolling collecting location without requiring the vehicles to carry extra electronic devices dedicated for electronic toll collection.

The foregoing examples of the related art and limitations related therewith are intended to be illustrative and not exclusive. Other limitations of the related art will become apparent upon a reading of the specification and a study of the drawings.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION OF EMBODIMENTS

Figure 1:
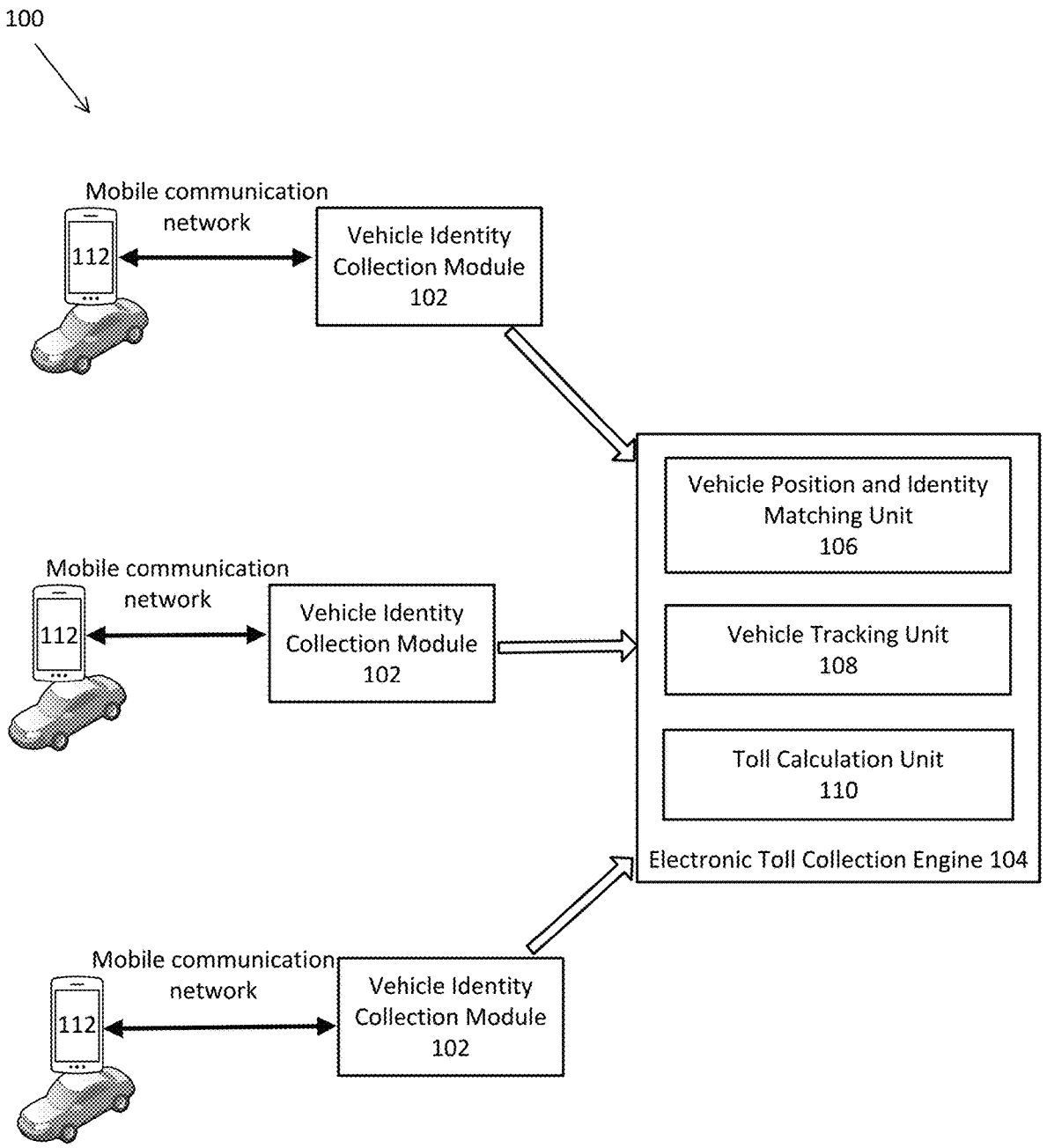
FIG. 1 depicts an example of a system diagram to support electronic toll collection (ETC) via mobile communication devices in accordance with some embodiments.

The following disclosure provides many different embodiments, or examples, for implementing different features of the subject matter. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

A new approach is proposed that contemplates systems and methods to support electronic toll collection (ETC) via mobile communication devices. A plurality of vehicle identity collection modules are deployed at different toll collecting locations, wherein each vehicle identity collection module is configured to broadcast wireless communication signals to cover a mobile communication device associated with a vehicle passing by the toll collection location over a wireless communication network, wherein strength of the wireless communication signals is maximized so that mobile communication device switches and connects with the vehicle identity collection module during a wireless cell re-selection process. A mobile communication channel is then established between the mobile communication device and the vehicle identity collection module following a wireless network communication protocol and identification information of one or more of the vehicle, the driver, and the mobile communication device is retrieved via the mobile communication channel. Based on the retrieved information, current toll collecting location is determined and actual moving path of the vehicle from its initial toll collecting location where the vehicle is first connected to a vehicle identity collection module to its current toll collecting location where the vehicle is last connected to a vehicle identity collection module is generated. A toll amount owed by the driver of the vehicle is then calculated based on the actual path from the initial toll collecting location to the current toll collecting location as well toll collection rules.

Under the proposed mobile communication-based ETC approach, a driver can rely on his/her cell phone for toll collection purpose when his/her vehicle passes through toll collecting locations without having to carry an extra electronic device such as a toll tag in each vehicle he/she is driving for the sole purpose of electronic toll collection. Since a unique communication channel is reliably established between the mobile communication device and the vehicle identity collection module at each toll collecting location, the proposed approach is always capable of accurately identifying the passing vehicles while eliminating potential toll collection errors that may happen under conventional ETC approaches. The proposed approach also enables toll collection at various locations along the road not limited to toll booths/stations.

FIG. 1 depicts an example of a diagram of system 100 to support mobile communication-based electronic toll collection. Although the diagrams depict components as functionally separate, such depiction is merely for illustrative purposes. It will be apparent that the components portrayed in this figure can be arbitrarily combined or divided into separate software, firmware and/or hardware components. Furthermore, it will also be apparent that such components, regardless of how they are combined or divided, can execute on the same host or multiple hosts, and wherein the multiple hosts can be connected by one or more networks.

In the example of FIG. 1, the system 100 includes at least a plurality of vehicle identity collection modules 102 and an electronic toll collection engine 104. Here, each of the vehicle identity collection modules 102 and the electronic toll collection engine 104 runs on one or more computing units/appliances/hosts (not shown), each with software instructions stored in a storage unit such as a non-volatile memory (also referred to as secondary memory) of the computing unit for practicing one or more processes. When the software instructions are executed, at least a subset of the software instructions is loaded into memory (also referred to as primary memory) by one of the computing units, which becomes a special purposed one for practicing the processes. The processes may also be at least partially embodied in the host into which computer program code is loaded and/or executed, such that, the host becomes a special purpose computing unit for practicing the processes. When implemented on a general-purpose computing unit, the computer program code segments configure the computing unit to create specific logic circuits. Here, each host can be a computing device, a communication device, a storage device, or any computing device capable of running a software component. For non-limiting examples, a computing device can be but is not limited to a laptop PC, a desktop PC, a tablet PC, or an x86 or ARM-based server running Linux or other operating systems. Each host has a communication interface (not shown), which enables vehicle identity collection modules 102 and the electronic toll collection engine 104 running on the hosts to communicate with each other following certain communication protocols, such as TCP/IP, http, https, ftp, and sftp protocols, over one or more communication networks (not shown). The communication networks can be but are not limited to, internet, intranet, wide area network (WAN), local area network (LAN), wireless network, Bluetooth, WiFi, and mobile communication network. The physical connections of the network and the communication protocols are well known to those of skill in the art.

In some embodiments, the vehicle identity collection modules 102 can be at geographically distinguishable locations (e.g., tool booths at different physical locations). In some embodiments, locations of the vehicle identity collection modules 102 can be anywhere on the roads where tolls need to be collected and are not limited to traditional toll booths. In some embodiments, the electronic toll collection engine 104 may reside either locally at the same location or remotely at different location (e.g., in a cloud) from the vehicle identity collection modules 102.

As shown in the example of FIG. 1, each of vehicle identity collection modules 102 can be in mobile communication with a mobile communication device 112 associated with (e.g., carried by) a user/driver of a vehicle following a wireless/cellular/mobile communication protocol, e.g., GSM, 3G, 4G, LTE, CDMA, W-CDMA, etc. Here, each mobile communication device 112 can be but is not limited to a mobile/hand-held device such as a smart phone, an iPhone, a tablet, an iPad, a Google's Android-based phone/device, and/or other types of mobile communication devices.

In some embodiments, the mobile communication device 112 having an interactive graphical user interface (GUI) is configured to have an ETC application or app running on it, wherein the ETC app is configured to maintain vehicle and/or driver identification (ID) number/information registered with an ETC system or service and to communicate such information to a vehicle identity collection module 102 at a toll collecting location. In some embodiments, identification information of the mobile communication device 112 (e.g. IMEI) can be used in alternative or in addition to the identification information for the vehicle and/or the driver. In some embodiments, the ETC app running on the mobile communication device 112 displays to the user/driver a map with navigation and route information including routes that has been traveled from the starting location and planned to the destination. The ETC app may further display toll collecting locations along the route and the estimated toll amount of the route. In some embodiments, ETC app further allows the user/driver to register and login to the ETC app, change its security and/or electronic payment settings, etc.

Figure 2:
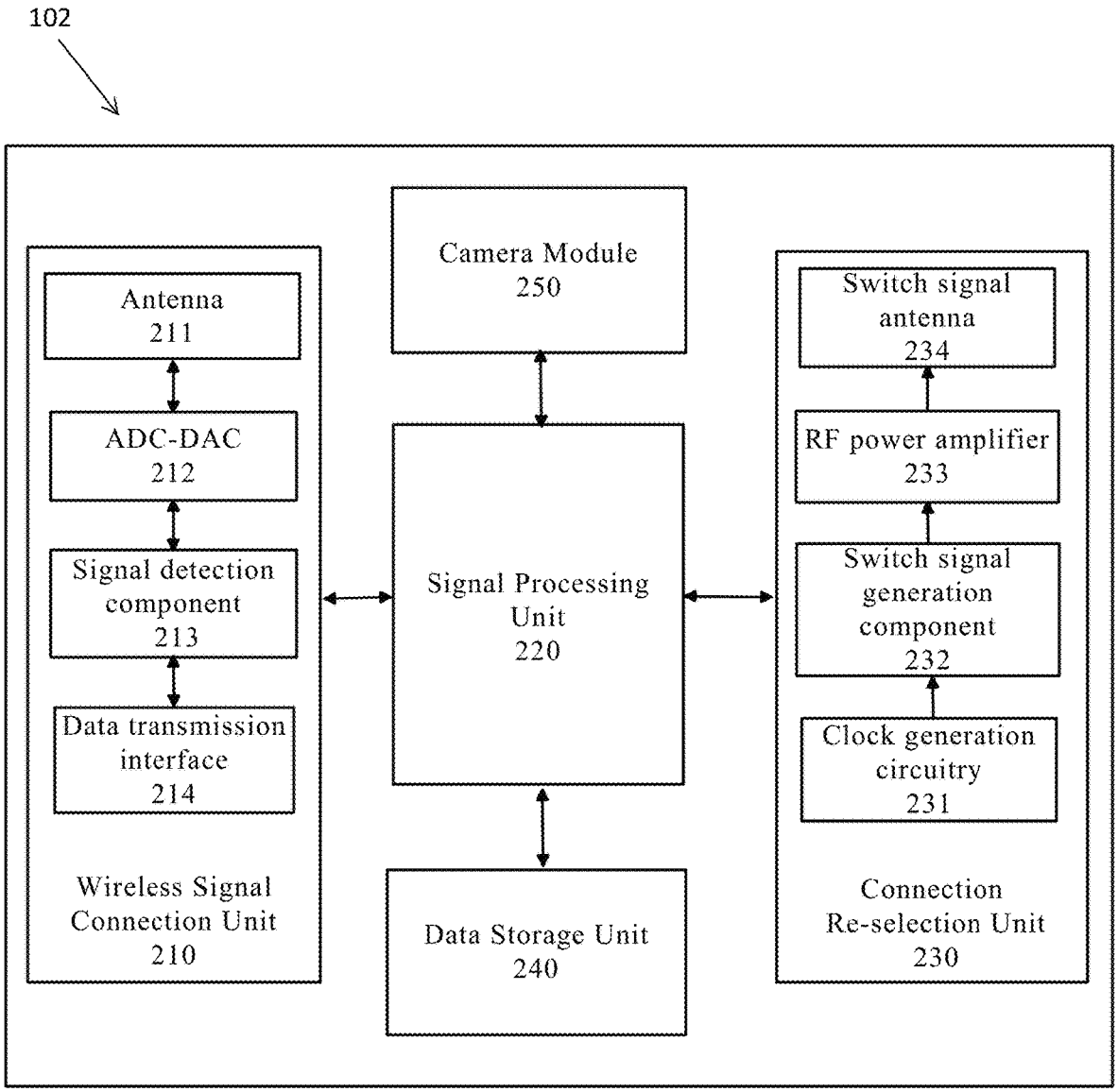
FIG. 2 depicts an example of a diagram demonstrating various functional components of each vehicle identity collection module depicted in FIG. 1 in accordance with some embodiments.

FIG. 2 depicts an example of a diagram demonstrating various functional components of each vehicle identity collection module 102 depicted in FIG. 1. As shown by the example of FIG. 2, the vehicle identity collection module 102 includes at least a wireless signal connection unit 210, a signal processing unit 220, a wireless connection reselection unit 230, and a data storage unit 240.

In the example of FIG. 2, the wireless signal connection unit 210 of the vehicle identity collection module 102 is configured to broadcast wireless communication signals to communicate with the mobile communication device 112 of a driver of a vehicle passing by a toll collection location over a wireless communication network in order to retrieve identification information of the vehicle and/or the driver. As shown in FIG. 2, the wireless signal connection unit 210 comprises one or more of antenna 211, analog-to-digital and digital to analog converter (ADC-DAC) 212, signal detection component 213, and data transmission interface 214. During its operation, the antenna 211 of the wireless signal connection unit 210 receives and/or transmits wireless communication signals from and/to the mobile communication device 112 associated with the driver of the passing-by vehicle. The analog signals received and/or sent to the antenna 211 is converted to and/or from digital signals by the ADC-DAC 212, wherein the converted signals are detected by the signal detection component 213 and are communicated with the signal processing unit 220 for further processing.

In the example of FIG. 2, the signal processing unit 220 of the vehicle identity collection module 102 is configured to establish and terminate a mobile communication channel/link with the mobile communication device 112 following a wireless network communication protocol, retrieve vehicle identification information from the passing-by vehicle via the mobile communication link, and maintain such information in the data storage unit 240 for submission to electronic toll collection engine 104. In some embodiments, the signal processing unit 220 effectively realizes functionalities of a base station by implementing the wireless network communication protocol standard (e.g., 3GPP) via software. Specifically, when digitalized wireless communication signals are received from the mobile communication device 112, the signal processing units 220 is configured to demodulate, correct errors, and decode the digitized signals to restore protocol data formatted after the wireless network communication protocol. When protocol data is to be sent out, the signal processing units 220 is configured to modulate and encode the protocol data into digital signals for the wireless signal connection unit 210 to send to the mobile communication device 112.

In some embodiments, the wireless network communication protocol typically comprises a physical layer for physically transmitting bit streams of data, a data link layer for establishing reliable wireless datalinks between the parties, and a network layer for receiving, transmitting the data. In some embodiments, the network layer further includes a wireless resource management layer for establishing data and control instruction transmission paths between the vehicle identity collection module 102 and the mobile communication device 112, a mobility management layer for processing position information of the mobile communication device 112, and a connection management layer for routing the data and control instructions between the vehicle identity collection module 102 and the mobile communication device 112.

In some embodiments, besides implementing the basic functions of the wireless network communication protocol, the signal processing units 220 is further configured to maximize strength of the wireless communication signals broadcasted by the wireless signal connection unit 210, which serves as a base station, to be strongest among the base stations covering the mobile communication device 112 by modifying one or more broadcasting parameters of the wireless resource management layer of the wireless network communication protocol. Note that a wireless/mobile communication network is divided geographically into many cells of base stations and there may be more than one base stations which coverage ranges overlap and cover the mobile communication device 112 at any time. Since the wireless network communication protocol does not certify or authenticate a base station the mobile communication device 112 connects to, in practice, the mobile communication device 112 may be able to re-select and connect to any of these base stations. By maximizing the signal strength within the coverage of the wireless signal connection unit 210, the signal processing unit 220 enables the mobile communication device 112 to always switch and re-connect to the wireless signal connection unit 210 following the wireless network communication protocol during the wireless cell re-selection process.

During the ETC process, the mobile communication device 112 continuously measures and ranks the wireless communication signal strength and quality of the its current cell and the neighboring cells to select the base station that provides the best quality of service in terms of wireless communication signal strength. In some embodiments, the signal processing unit 220 is configured to control the connection re-selection unit 230 of the vehicle identity collection module 102 to generate and transmit one or more switch signals to dynamically affect and maximize the wireless communication signals broadcasted by the wireless signal connection unit 210 so that the broadcasted wireless communication signals are the strongest and/or the most stable among all of the base stations covering the mobile communication device 112. As a result, the mobile communication device 112 would always switch to the wireless signal connection unit 210 during the wireless cell re-selection process without base station authentication.

In some embodiments, the connection re-selection unit 230 further comprises a clock generation circuitry 231, which generates a series of precise time pulses for a switch signal generation component 232 using a timer (not shown) as a stability controller. The switch signal generation component 232 of the connection re-selection unit 230 is configured to generate the switch signals based on the time pulses under the control of the signal processing unit 220 as discussed above. In some embodiments, the switch signal generation component 232 further utilizes a voltage-controlled oscillator (not shown) and a waveform generator (not shown) to generate the switch signals. The generated switch signals are then amplified by a radio frequency (RF) power amplifier 233 of the connection re-selection unit 230 before they are transmitted via a switch signal antenna 234. Here, the switch signal antenna 234 may utilize antennas of different frequencies to accommodate different types of wireless communication networks. For non-limiting examples, the switch signal antenna 234 adopts work frequency ranges of 1880 MHz to 1900 MHz and 2010 MHz to 2025 MHz for TD-SCDMA, 2130 MHz to 2145 MHz for W-CDMA, and 2110 MHz to 2125 MHz for CDMA2000.

When the mobile communication device 112 receives the enhanced/maximized wireless communication signals broadcasted by the wireless signal connection unit 210 based on parameters modified by the signal processing unit 220, the mobile communication device 112 initiates its wireless cell re-selection process by transmitting a connection request to the wireless signal connection unit 210 via a Random Access Channel (RACH) to apply for a Stand-Alone Dedicated Control Channel (SDCCH) with the wireless signal connection unit 210. In response to the connection request, the signal processing unit 220 allocates the SDCCH channel and the wireless signal connection unit 210 transmits information of the allocated SDCCH channel to the mobile communication device 112 via an Access Grant Channel (AGCH). The mobile communication device 112 then connects to the wireless signal connection unit 210 via the allocated SDCCH channel and requests an update of its current location via, e.g., a location update request.

Once the wireless cell re-selection process is complete, the signal processing unit 220 then requests and retrieves identification information from the mobile communication device 112, wherein such identification information includes but is not limited to identification information for the vehicle, the driver, and/or the mobile communication device 112 (e.g., IMEI). Once the identification information is provided by the mobile communication device 112, the signal processing unit 220 is configured to retrieve such identification information following the wireless communication protocol. In some embodiments, the signal processing unit 220 is configured to retrieve location information of the vehicle identity collection module 102 and generates location update information for the identified mobile communication device 112 based on the retrieved location of the vehicle identity collection module 102. In some embodiments, the signal processing unit 220 is configured to store both the retrieved identification information and/or location information of the mobile communication device 112 to the data storage unit 240, wherein such identification information and/or location information of the mobile communication device 112 is transmitted to the electronic toll collection engine 104 in real time for route tracking and toll calculation of the vehicle.

In the example of FIG. 1, the electronic toll collection engine 104 includes a vehicle position and identity matching unit 106 configured to match the location and/or identification information of the vehicle, driver, and/or the mobile communication device 112 with the location information of the vehicle identity collection module 102 to determine the current toll collecting location of the vehicle. In some embodiments, the location information of the vehicle identity collection module 102 is provided to and maintained by the electronic toll collection engine 104 beforehand. In some embodiments, the vehicle position and identity matching unit 106 then transmits the matched identification and location information of the vehicle to the vehicle tracking unit 108, which is configured to generate the actual moving path/route of the vehicle from its initial toll collecting location where the vehicle is first connected to (and thus sensed) by a vehicle identity collection module 102 to its current (e.g., ending or exiting) toll collecting location where the vehicle is last connected to (and sensed by) a vehicle identity collection module 102 on the current trip. In some embodiments, the moving path may include one or more intermediate toll collecting locations between the initial and the ending toll collecting locations the vehicle has passed by along the way, wherein the vehicle identity collection module 102 at each of the toll collecting locations is configured to transmit the identification information of the vehicle, the driver, and/or the mobile communication device 112 to the vehicle tracking unit 108. Based on the generated moving path of the vehicle, the toll collection unit 110 of the electronic toll collection engine 104 is configured to calculate a toll amount owed by the driver of the vehicle based on the distance it has traveled and/or the toll collecting locations it has passed along the actual path from the initial location to the ending location as well toll collection rules (e.g., toll that should be charged for different segments of the path). By calculating the toll amount based on the actual moving path of the vehicle through the toll collecting locations, the electronic toll collection engine 104 is able to yield an accurate toll amount for collection.

In some embodiments, the vehicle identity collection module 102 further includes a high resolution video camera module 250 configured to capture and identify identification information (e.g., vehicle license plate number) of the vehicle when it is passing through the toll collecting location. Such video camera-based vehicle information capture is supplemental to the identification information of the driver especially when the identification information of the vehicle, the driver, and/or the mobile communication device 112 cannot be retrieved when the vehicle passes through the vehicle identity collection module 102 at a toll collecting location if the driver does not carry the mobile communication device 112 or the mobile communication device 112 is powered off or the wireless network communication link between the vehicle identity collection module 102 and the mobile communication device 112 is interrupted. The captured vehicle identification information is then transmitted to the electronic toll collection engine 104, wherein the toll collection unit 110 is configured to calculate the toll amount based on the initial and exiting locations of the vehicle having the same identification information, e.g., vehicle license plate number, according to the toll collection rules.

In some embodiments, the electronic toll collection engine 104 is configured to push the generated actual path and/or the calculated toll amount to the ETC app running on the mobile communication device 112 so that the driver/user may track his/her toll collection status in real time. In some embodiments, the electronic toll collection engine 104 is configured to push a notification to the driver through the ETC app when the mobile communication device 112 is detected passing by a vehicle identity collection module 102 at a toll collecting location so that the driver knows that his/her current trip is being tracked and tolled in real time. If the driver believes that his/her vehicle is being detected and/or tolled by mistake, he/she may inform the electronic toll collection engine 104 and request for a correction immediately via his/her mobile communication device 112.

Figure 3:
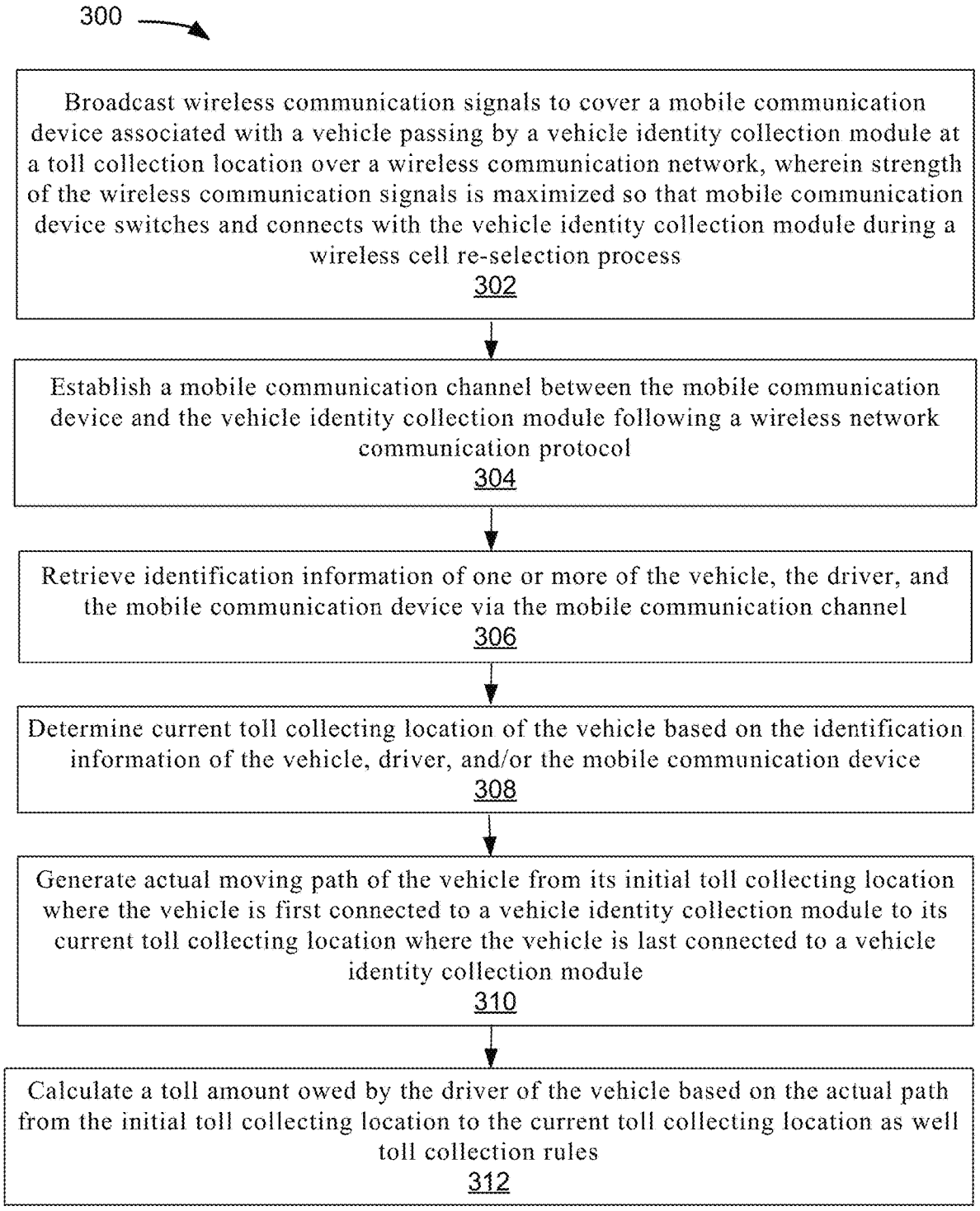
FIG. 3 depicts an example of a flowchart of a process to support electronic toll collection via mobile communication devices in accordance with some embodiments.

FIG. 3 depicts an example of a flowchart of a process to support electronic toll collection (ETC) via mobile communication devices. Although this figure depicts functional steps in a particular order for purposes of illustration, the process is not limited to any particular order or arrangement of steps. One skilled in the relevant art will appreciate that the various steps portrayed in this figure could be omitted, rearranged, combined and/or adapted in various ways.

In the example of FIG. 3, the flowchart 300 starts at block 302, where wireless communication signals are broadcasted to cover a mobile communication device associated with a vehicle passing by a vehicle identity collection module at a toll collection location over a wireless communication network, wherein strength of the wireless communication signals is maximized so that mobile communication device switches and connects with the vehicle identity collection module during a wireless cell re-selection process. The flowchart 300 continues to block 304, where a mobile communication channel is established between the mobile communication device and the vehicle identity collection module following a wireless network communication protocol. The flowchart 300 continues to block 306, where identification information of one or more of the vehicle, the driver, and the mobile communication device is retrieved via the mobile communication channel. The flowchart 300 continues to block 308, where current toll collecting location of the vehicle is determined based on the identification information of the vehicle, driver, and/or the mobile communication device. The flowchart 300 continues to block 310, where actual moving path of the vehicle from its initial toll collecting location where the vehicle is first connected to a vehicle identity collection module to its current toll collecting location where the vehicle is last connected to a vehicle identity collection module is generated. The flowchart 300 ends at block 312, where a toll amount owed by the driver of the vehicle is calculated based on the actual path from the initial toll collecting location to the current toll collecting location as well toll collection rules.

One embodiment may be implemented using a conventional general purpose or a specialized digital computer or microprocessor(s) programmed according to the teachings of the present disclosure, as will be apparent to those skilled in the computer art. Appropriate software coding can readily be prepared by skilled programmers based on the teachings of the present disclosure, as will be apparent to those skilled in the software art. The invention may also be implemented by the preparation of integrated circuits or by interconnecting an appropriate network of conventional component circuits, as will be readily apparent to those skilled in the art.

The foregoing description of various embodiments of the claimed subject matter has been provided for the purposes of illustration and description. It is not intended to be exhaustive or to limit the claimed subject matter to the precise forms disclosed. Many modifications and variations will be apparent to the practitioner skilled in the art. Particularly, while the concept "component" is used in the embodiments of the systems and methods described above, it will be evident that such concept can be interchangeably used with equivalent concepts such as, class, method, type, interface, module, object model, and other suitable concepts. Embodiments were chosen and described in order to best describe the principles of the invention and its practical application, thereby enabling others skilled in the relevant art to understand the claimed subject matter, the various embodiments and with various modifications that are suited to the particular use contemplated.

What is claimed is:

1. A system to support electronic toll collection (ETC) via mobile communication devices, comprising:

a plurality of vehicle identity collection modules, each at a toll collection location and configured to broadcast wireless communication signals to cover a mobile communication device associated with a vehicle passing by the toll collection location over a wireless communication network, wherein strength of the wireless communication signals is increased within a coverage area so that mobile communication device switches and connects with the vehicle identity collection module during a wireless cell re-selection process;

establish a mobile communication channel with the mobile communication device following a wireless network communication protocol;

retrieve identification information of one or more of the vehicle, the driver, and the mobile communication device via the mobile communication channel;

an electronic toll collection engine running on a host, which in operation, is configured to determine current toll collecting location of the vehicle based on the identification information of the vehicle, driver, and/or the mobile communication device;

generate actual moving path of the vehicle from its initial toll collecting location where the vehicle is first connected to a vehicle identity collection module to its current toll collecting location where the vehicle is last connected to a vehicle identity collection module;

calculate a toll amount owed by the driver of the vehicle based on the actual path from the initial toll collecting location to the current toll collecting location as well toll collection rules.

2. The system of claim 1, wherein:

the plurality of vehicle identity collection modules are at geographically distinguishable toll collecting locations.

3. The system of claim 1, wherein:

the wireless communication network is one of GSM, 3G, 4G, LTE, CDMA, and W-CDMA.

4. The system of claim 1, wherein:

the mobile communication device is configured to have an ETC app running on it, wherein the ETC app is configured to maintain identification (ID) number/information of the vehicle, the user, and/or the mobile communication device; and communicate such information to the vehicle identity collection module at a toll collecting location.

5. The system of claim 1, wherein:

the vehicle identity collection module is configured to modulate and encode data formatted after the wireless network communication protocol into digital signals for transmission to the mobile communication device;

demodulate, error-check, and decode digitized signals received from the mobile communication device to restore protocol data.

6. The system of claim 1, wherein:

the vehicle identity collection module is configured to maximize the strength of the broadcasted wireless communication signals to be strongest among base stations covering the mobile communication device by modifying one or more broadcasting parameters of the wireless network communication protocol.

7. The system of claim 6, wherein:

the vehicle identity collection module is configured to generate and transmit one or more switch signals to dynamically affect the broadcasted wireless communication signals so that they are the strongest and/or the most stable among all of the base stations covering the mobile communication device.

8. The system of claim 7, wherein:

the vehicle identity collection module is configured to generate the switch signals based on a series of precise time pulses.

9. The system of claim 7, wherein:

the vehicle identity collection module is configured to transmit the switch signals via antennas of different frequencies to accommodate different types of wireless communication networks.

10. The system of claim 1, wherein:

the vehicle identity collection module is configured to transmit location information and/or the identification information of the vehicle, the driver, and/or the mobile communication device in real time for route tracking and toll calculation of the vehicle.

11. The system of claim 1, wherein:

the moving path includes a plurality of toll collecting locations the vehicle has passed by along the path, wherein the vehicle identity collection module at each of the toll collecting locations is configured to transmit the identification information of the vehicle for toll calculation.

12. The system of claim 1, wherein:

the vehicle identity collection module further includes a high resolution video camera module configured to capture and identify the identification information of the vehicle when it is passing through the toll collecting location.

13. The system of claim 1, wherein:

the electronic toll collection engine is configured to push the generated actual path and/or the calculated toll amount to an ETC app running on the mobile communication device for the driver to track his/her toll collection status in real time.

14. The system of claim 1, wherein:

the plurality of vehicle identity collection modules are each configured to retrieve the identification information of the mobile communication device via the mobile communication channel, and the electronic toll collection engine running is configured to determine the current toll collecting location of the vehicle based on the identification information of the mobile communication device, wherein the identification information of the mobile communication device is an International Mobile Equipment Identity (IMEI) of the mobile communication device.

15. The system of claim 1, wherein the wireless communication signals are stronger and more stable than a cell signal covering the mobile communication device.

16. A method to support electronic toll collection (ETC) via mobile communication devices, comprising:

broadcasting wireless communication signals to cover a mobile communication device associated with a vehicle passing by a vehicle identity collection module at a toll collection location over a wireless communication network, wherein strength of the wireless communication signals is increased within a coverage area so that mobile communication device switches and connects with the vehicle identity collection module during a wireless cell re-selection process;

establishing a mobile communication channel between the mobile communication device and the vehicle identity collection module following a wireless network communication protocol;

retrieving identification information of one or more of the vehicle, the driver, and the mobile communication device via the mobile communication channel;

determining current toll collecting location of the vehicle based on the identification information of the vehicle, driver, and/or the mobile communication device;

generating actual moving path of the vehicle from its initial toll collecting location where the vehicle is first connected to a vehicle identity collection module to its current toll collecting location where the vehicle is last connected to a vehicle identity collection module;

calculating a toll amount owed by the driver of the vehicle based on the actual path from the initial toll collecting location to the current toll collecting location as well toll collection rules.

17. The method of claim 16, further comprising:

modulating and encoding data formatted after the wireless network communication protocol into digital signals for transmission to the mobile communication device;

demodulating, error-checking, and decoding digitized signals received from the mobile communication device to restore protocol data.

18. The method of claim 16, further comprising:

maximizing the strength of the broadcasted wireless communication signals to be strongest among base stations covering the mobile communication device by modifying one or more broadcasting parameters of the wireless network communication protocol.

19. The method of claim 18, further comprising:

generating and transmitting one or more switch signals to dynamically affect the broadcasted wireless communication signals so that they are the strongest and/or the most stable among all of the base stations covering the mobile communication device.

20. The method of claim 19, further comprising:

transmitting the switch signals via antennas of different frequencies to accommodate different types of wireless communication networks.

21. The method of claim 16, further comprising:

capturing and identifying the identification information of the vehicle when it is passing through the toll collecting location via a high resolution video camera module.

22. The method of claim 16, further comprising:

pushing the generated actual path and/or the calculated toll amount to an ETC app running on the mobile communication device for the driver to track his/her toll collection status in real time.

* * * * *